US005131644A

United States Patent [19]

DuBois

[11] Patent Number: 5,131,644

[45] Date of Patent: Jul. 21, 1992

[54] SORTER AND RECEIVING TRAY

[76] Inventor: R. Clark DuBois, 332 Wakeman Rd., Fairfield, Conn. 06430

[21] Appl. No.: 310,570

[22] Filed: Feb. 15, 1989

[51] Int. Cl.[5] ..... B65H 29/38

[52] U.S. Cl. ..... 271/84; 271/220; 271/303

[58] Field of Search ..... 271/84, 207, 217, 218, 271/220, 221, 222, 303

[56] References Cited

U.S. PATENT DOCUMENTS

| | | | |
|---|---|---|---|
| 2,341,021 | 2/1944 | Curtis | 271/221 X |
| 3,369,807 | 2/1968 | Whelen | 271/84 X |
| 4,033,579 | 7/1977 | Stange | 271/217 X |

FOREIGN PATENT DOCUMENTS

| | | | |
|---|---|---|---|
| 178367 | 8/1986 | Japan | 271/220 |

*Primary Examiner*—Richard A. Schacher

*Attorney, Agent, or Firm*—Francis J. Bouda

[57] ABSTRACT

A sorter and receiving tray for paper sheets is described, including the control of each paper sheet so that there is positive displacement of the sheet into the receiving tray. The device disclosed includes both a top and bottom feeding mechanism, each of which controls with positive displacement the placing of the sheet into a receiving tray.

Additionally, the sorter of the present invention controls the curl of the paper and includes fixed trays which can be fully loaded with paper, inasmuch as the curl problem is eliminated. The sorter also includes a signal device to indicate when a receiving tray is filled with paper. The sorter and receiving tray of the present invention is particularly arranged to avoid interference between the sheets of paper, and to eliminate paper jams, mis-sorts, and the like.

21 Claims, 14 Drawing Sheets 21B
21
22
1

2
11
12
21
22
10
9
9A
9A
8
6
7
5
5
4

Fig. 10
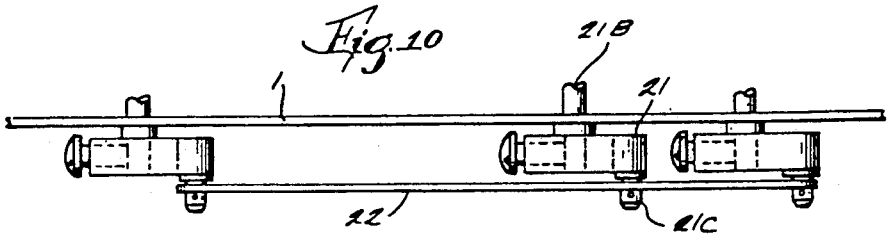
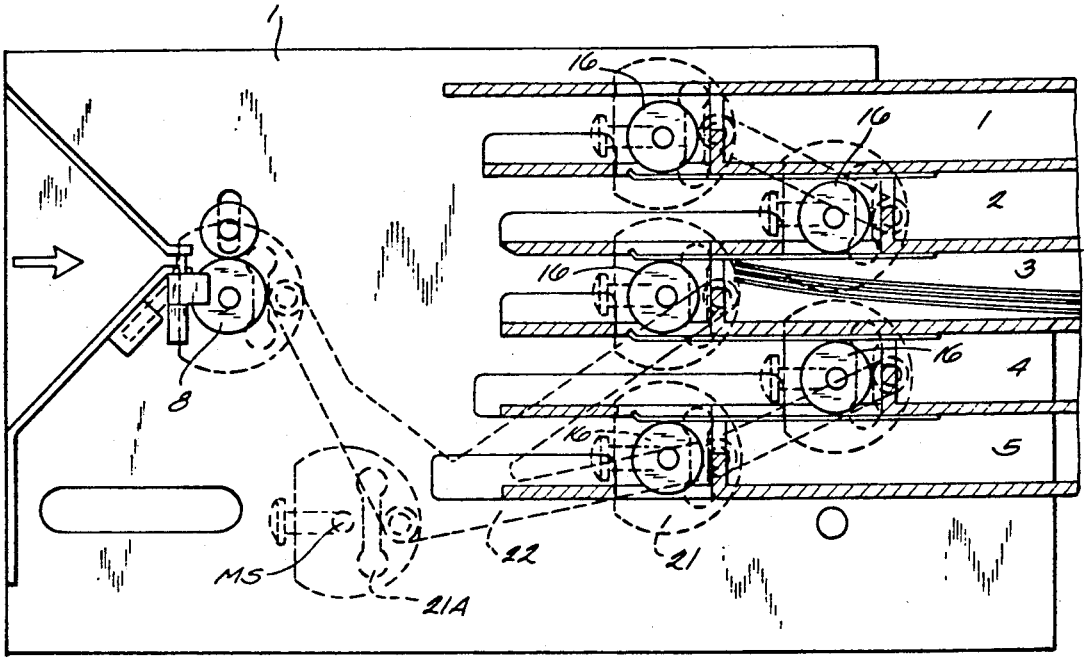
Fig. 9
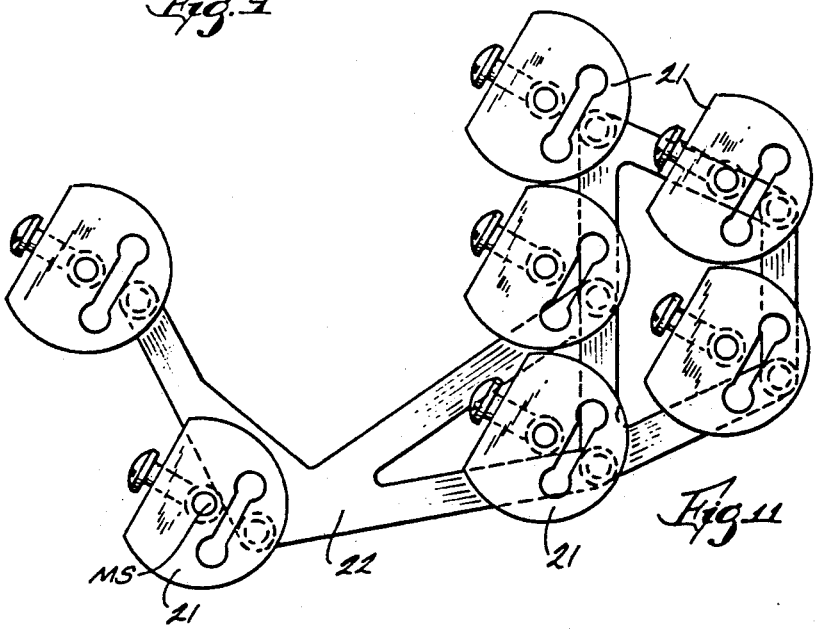
Fig. 11

SORTER AND RECEIVING TRAY

BACKGROUND OF THE INVENTION

Devices for sorting and stacking sheets of paper are not new, but it can be generally stated that all other sorters need enough velocity for the sheet to be thrown in to the tray. As the rollers that drive the paper are not in the tray stacking area, the only way for the paper to get fully into the tray is to be thrown. Upward sloping trays are the result, and it is important to have the tail edge of the sheets in the tray near the entry point of the next sheet to avoid head-to-tail crashes of the paper.

Thus it is the common practice to have the new sheet thrown into a tray which is sloped up at about 40 degrees. The paper entering the tray normally goes several inches beyond where it must come to rest, but slides back because of the tray slope.

There have been "Chain delivery stackers" on printing presses made by companies such as Addressagraph Multigraph, Ditty Glasser, and others for many years. These pull the sheet into the stacking area for reliable stacking.

Other sorters feed the new sheet about one inch or more over the lower surface of the tray area, even when the capacity is only a quarter of an inch stack of paper. This is done because the trailing edge, or corner, of the top sheets in the tray often curl up. If the leading edge of the new sheet coming into the tray hits the tail edge of a sheet already in the tray, there is a paper jam, a mis-sort, or a sheet is pushed out of the stacking area. Feeding the paper well above where the sheets in the tray should lie is the conventional way to solve this problem, but very curled paper still causes problems. Also, it adds size to the sorter and/or the need to open the tray spacing to receive a sheet. Examples of sorters that open the tray spacing so that the new sheet can come into the tray well above the sheets in the tray, then closing the stack to reduce the size of the sorter are shown in U.S. Pat. Nos.:

| | |
|---|---|
| U.S. Pat. No. 2,589676 | Crissy |
| U.S. Pat. No. 4,328,962 | DuBois |
| U.S. Pat. No. 4,332,377 | DuBois |
| U.S. Pat. No. 4,397,461 | DuBois |
| U.S. Pat. No. 4,433,837 | Romanowski |

The present invention uses fixed trays that can be fully loaded with paper as the curl problem is eliminated.

SUMMARY OF THE INVENTION

The sorter and receiving tray of the present invention is an improvement over the prior art for several reasons.

The present invention uses fixed trays that can be fully loaded with paper as the curl problem is eliminated.

Furthermore, it is useful to the operator if the system detects when at least one of the trays is full. This is relatively easy if the fingers are driven up by a cam and a spring or gravity pulls them down. As part of the finger is on top of the sheets in the trays, a full tray will prevent the full downward motion, and this can be detected by a suitable switch.

Another improvement of the present invention is a design of the drive mechanism which includes a wobble plate. Wobble plate drives have been well-known for many years in multi-spindle drilling heads. In such prior devices, a plate of tool steel moved to drive many drives. The improvement of the present invention, and which is believed to be novel, is that in the drive of the present invention, a slot is provided which affords some "give" in the radial direction, while retaining stiffness in the tangential direction. This is simply done with a slot between the shat and the off-center driving point. The point which is shown in the drawings as a stud could be a hole, with the stud in the wobble plate.

Furthermore, in the present invention, I have provided means or a signal which indicates that some of the trays are empty (i.e., devoid of sheets). This is the case where the logic of the system counts the sheets that go into each tray as a way to tell when a tray is full. Or, when a new set of sheets is to be received and the system is to put them into any empty tray. As the system has no knowledge when a person takes the sheets from a tray, and this can happen at any time, a signal is needed. With the Top-Fed mailbox Sorter of the present invention, it is easy and cheap to make a sensor in each tray that is normally out of the way of the paper that enters the tray, is insensitive to the color of the sheet and the markings on the sheet (unlike some photo detectors), and will check every tray each time the fingers make their motion. As one often needs to know the tray status at the start of a printing operation, an extra cycle of the sorter can be made at that time to provide the signal when needed. The contacts in each tray can be driven separately.

The paper sorter shown may have one or more trays to receive paper in a preferred order. Two designs are shown. The first is a five tray sorter where the paper is positively put in each tray, on top of other sheets, and the paper curl is controlled. The second is a single tray where the new sheet is put under the other sheets in the tray. This second design can be made into a sorter by having several trays, perhaps driven by the same cam system.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

Figure 5:
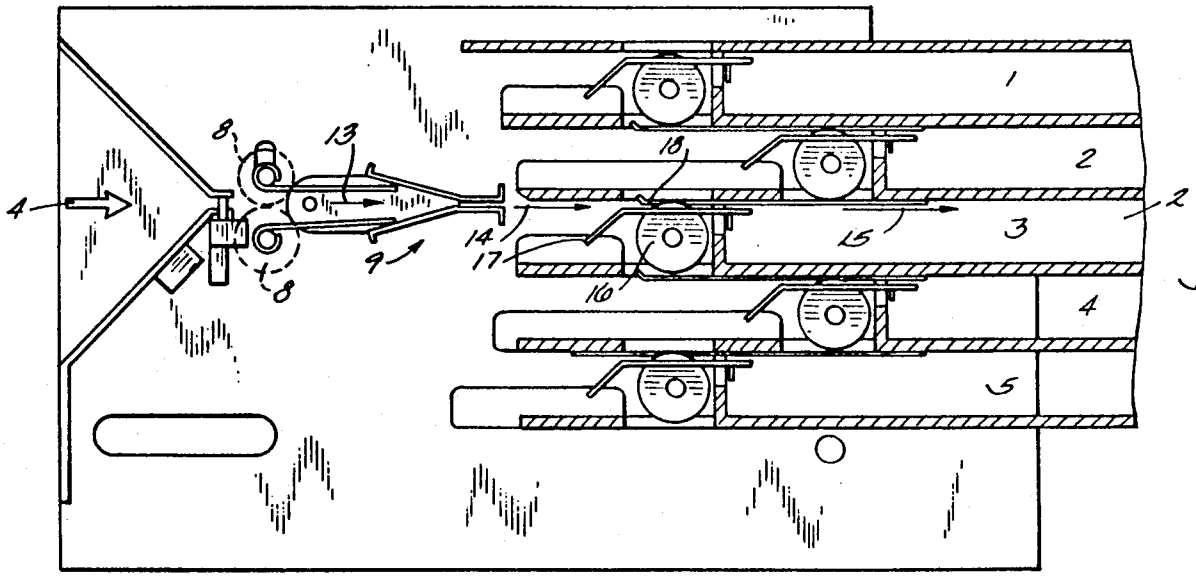
FIG. 5 is a view similar to FIG. 2, simplified to show the movement of the paper.
Figure 7:
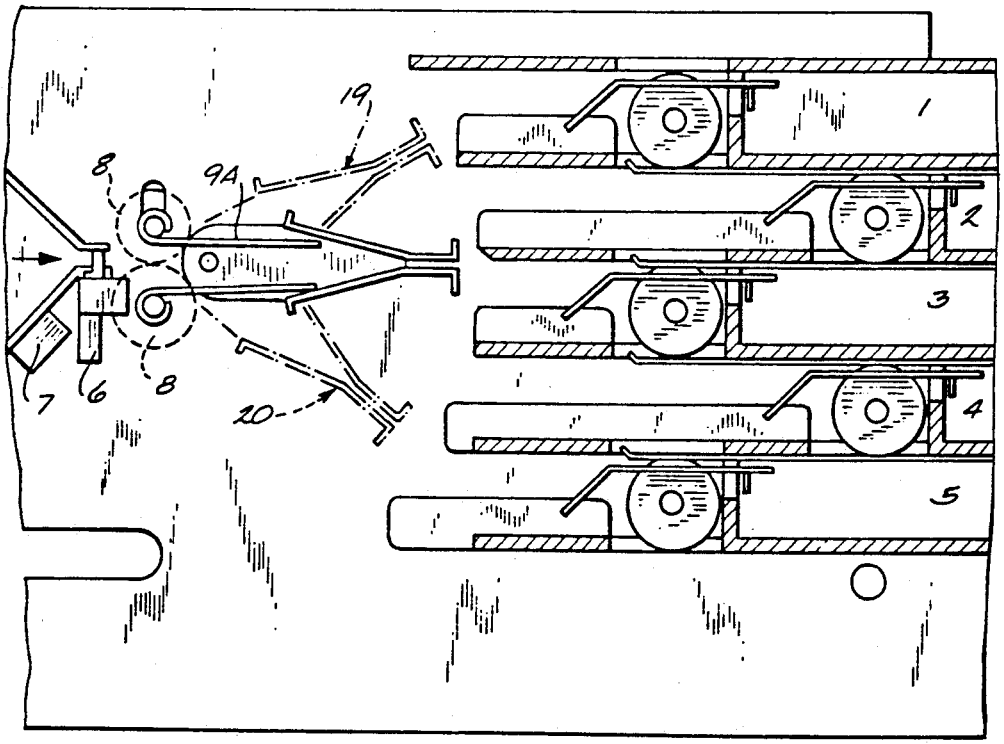

FIG. 7, similar to FIG. 5, illustrates several positions of the pivoting gate.

FIGS. 8*a*, 8*b*, 8*c* and 8*d* illustrate the movement of the paper into the receiving trays.

FIG. 9 illustrates the chin of the drive rollers and the drive tires as driven by the motor shaft and drive hubs.

Figure 1:
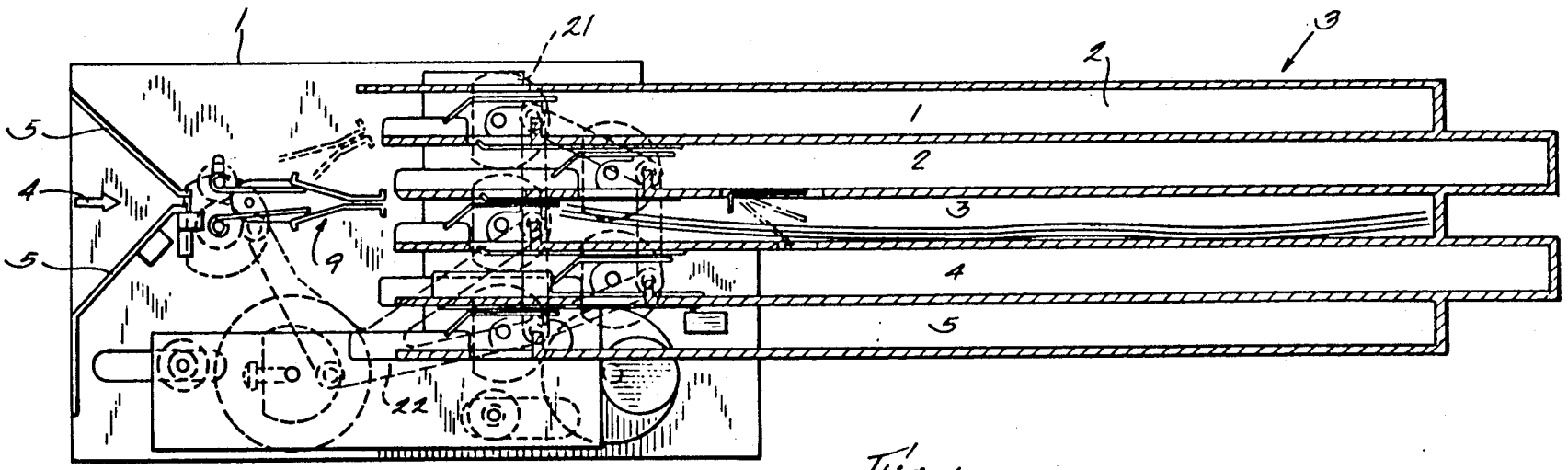
FIG. 1 is a vertical side elevational view, partly in section, of the Sorter and Receiving Tray of the present invention.
Figure 3:
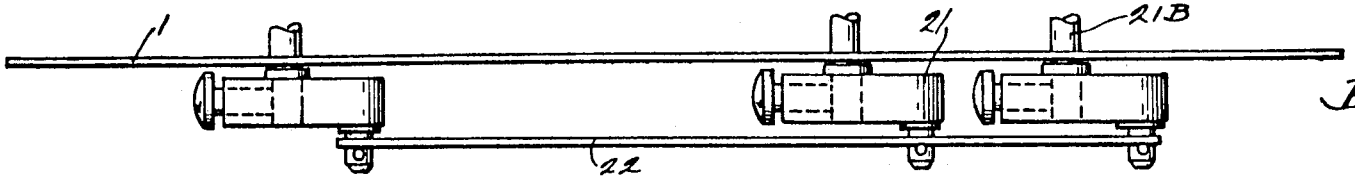
FIG. 3 is a bottom plan view of the side frame drive hubs and shafts.
Figure 2:
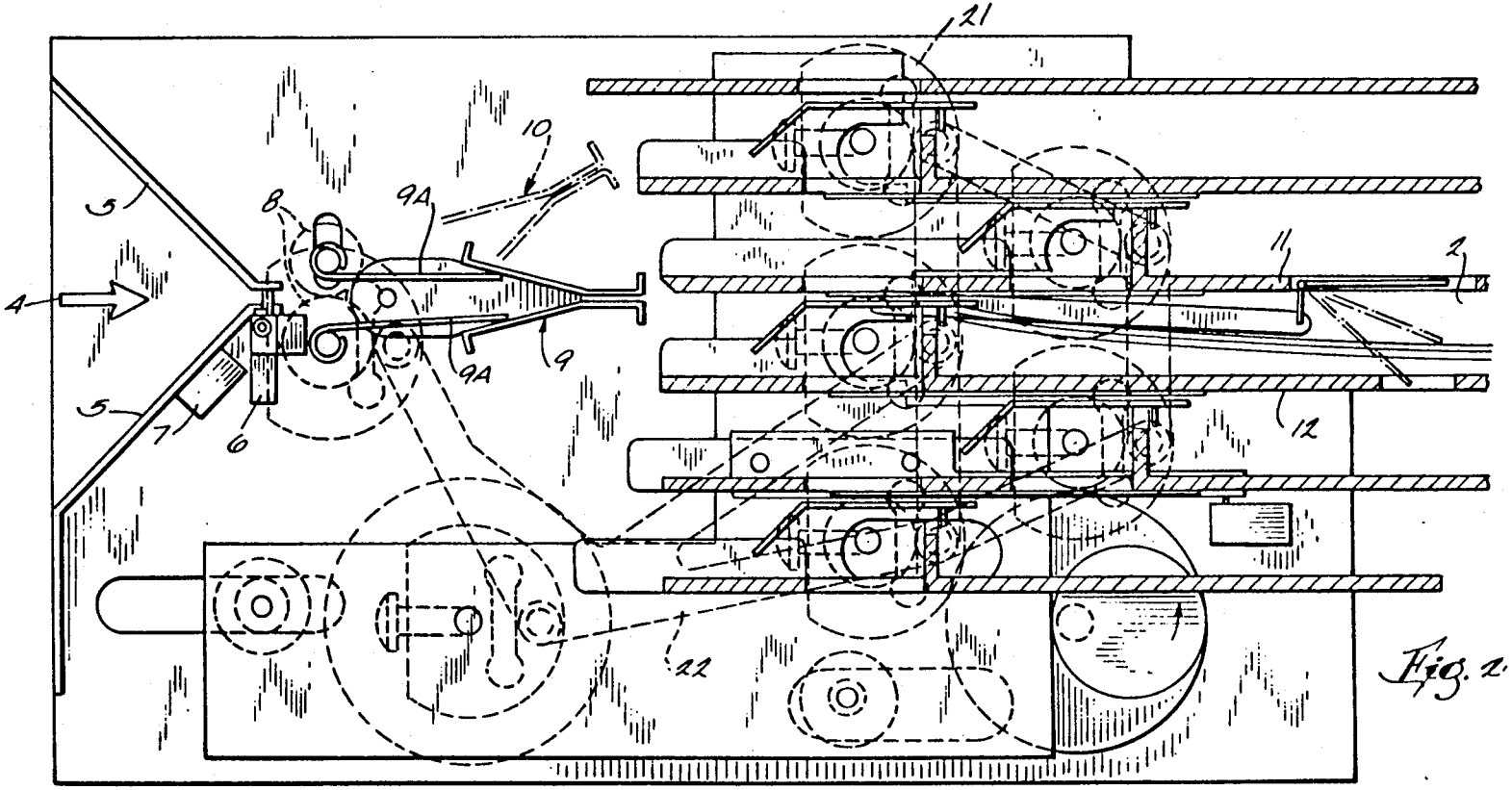
FIG. 2 is an enlarged closeup view of the working area shown in FIG. 1.
Figure 4:
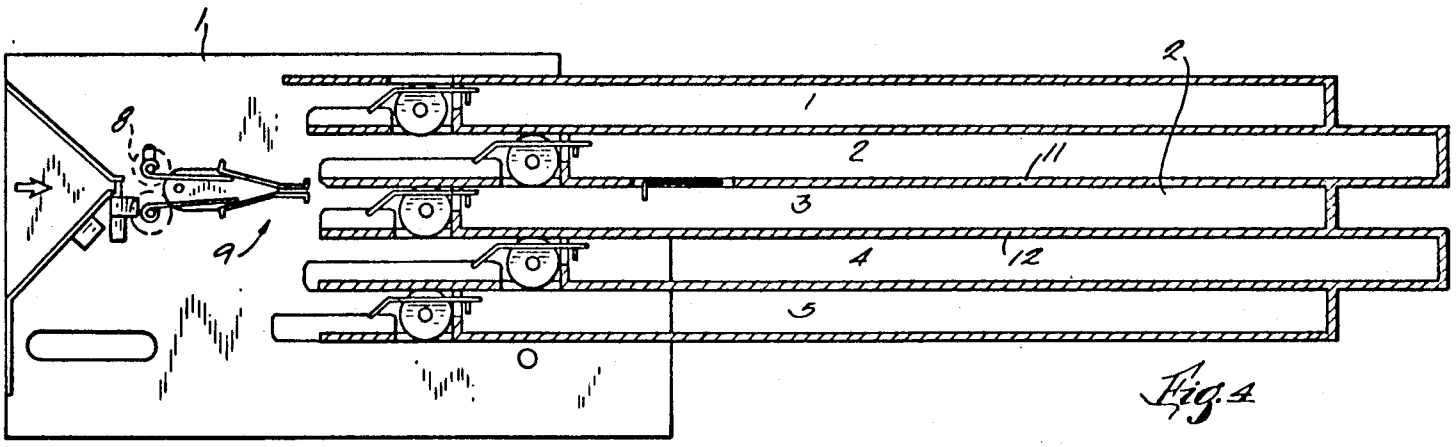
FIG. 4 is a simplified schematic view similar to FIG. 1.

FIG. 10 is a simplified view similar to FIG. 3.

FIG. 11 is a highly stylized schematic view of the drive hubs and motor shaft.

Figure 12A:
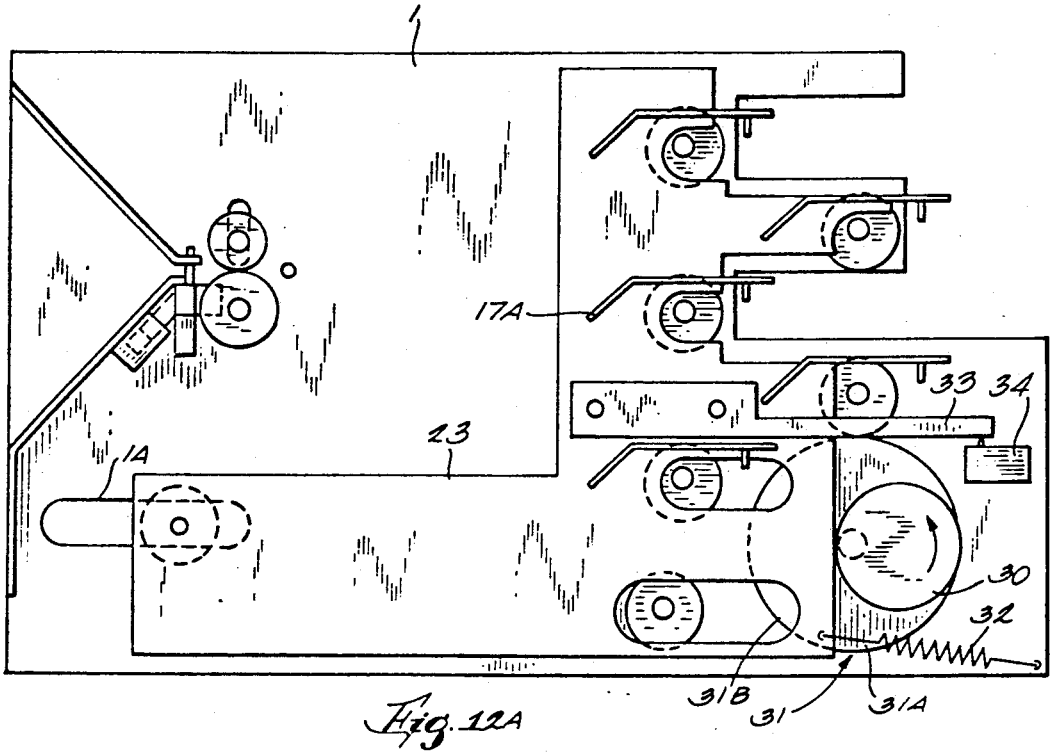
Figure 12B:
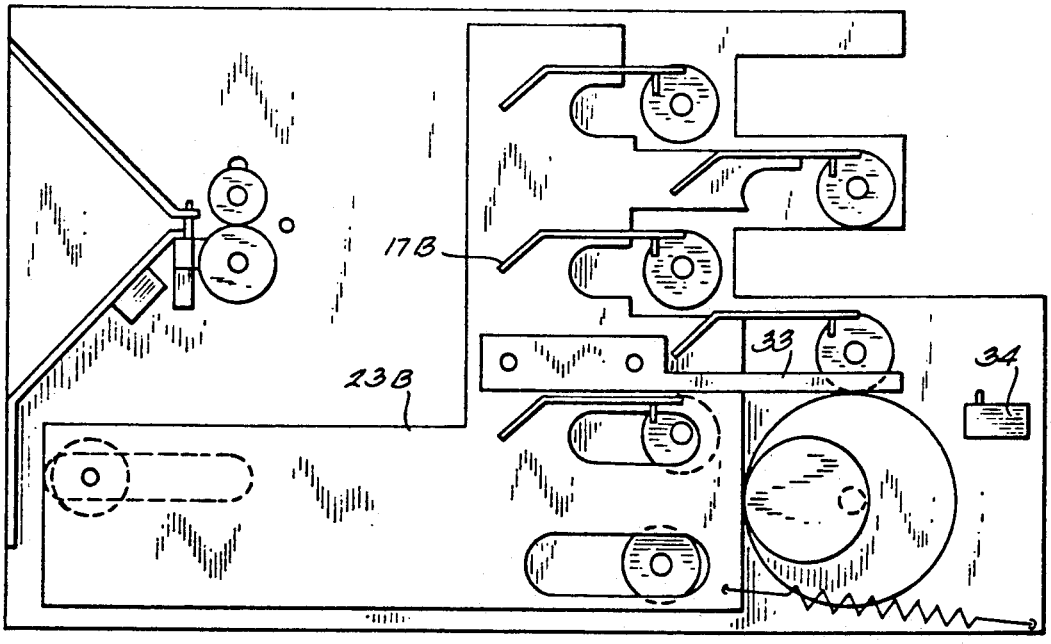
Figure 12C:
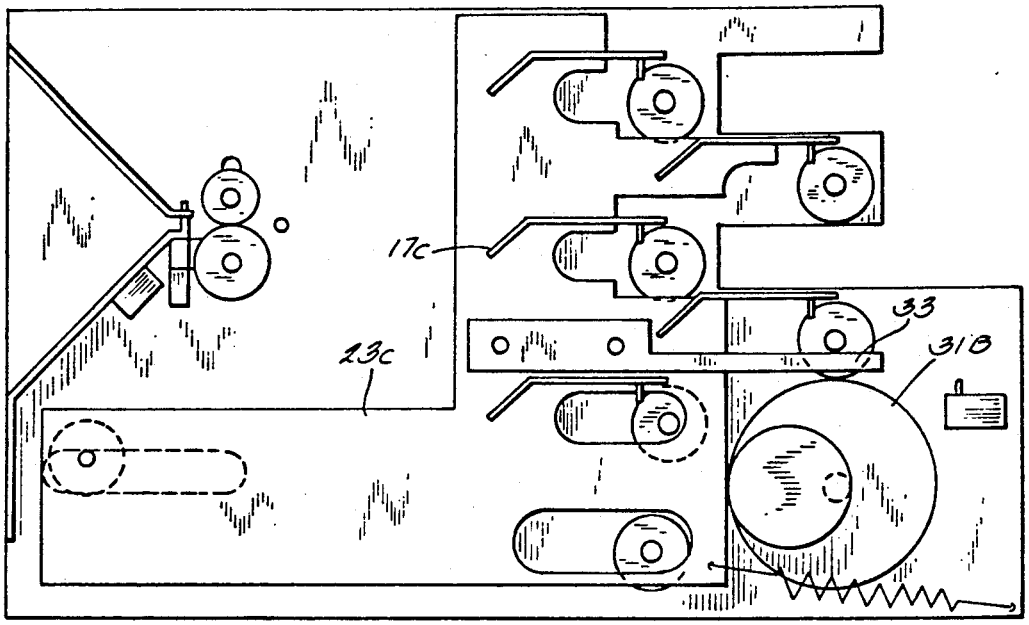
Figure 12D:
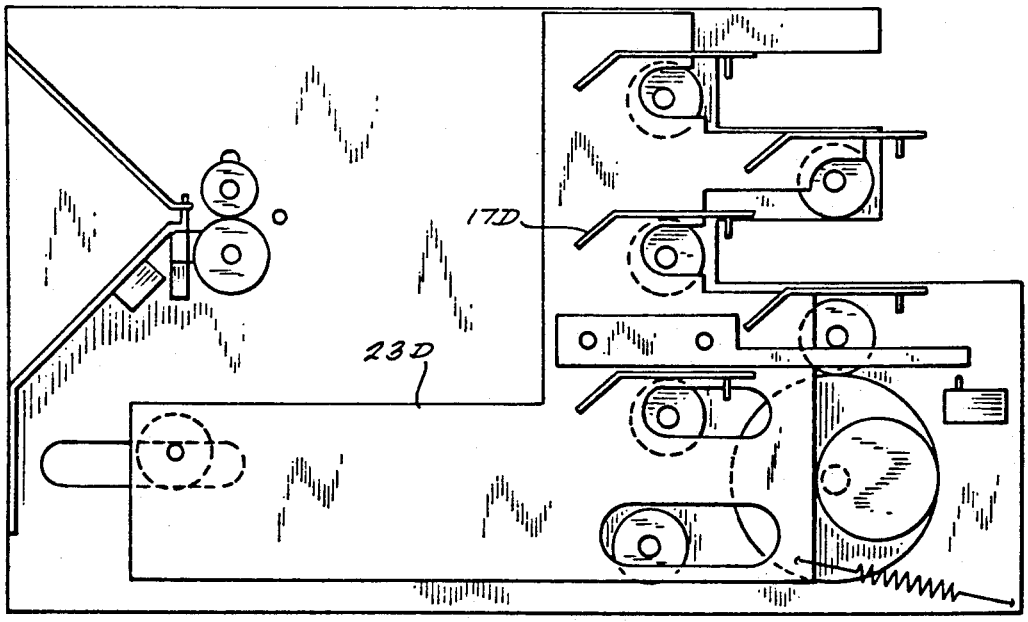

FIGS. 12*a*, *b*, *c*, and *d* illustrate the sequential action of the gates.

Figure 13:
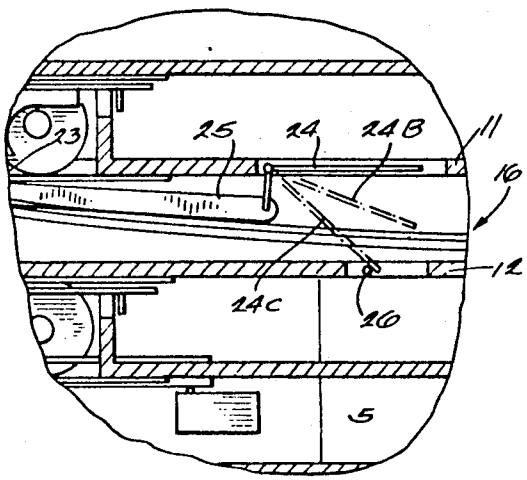

FIG. 13 illustrates the switch in tray No. 3.

Figure 14C:
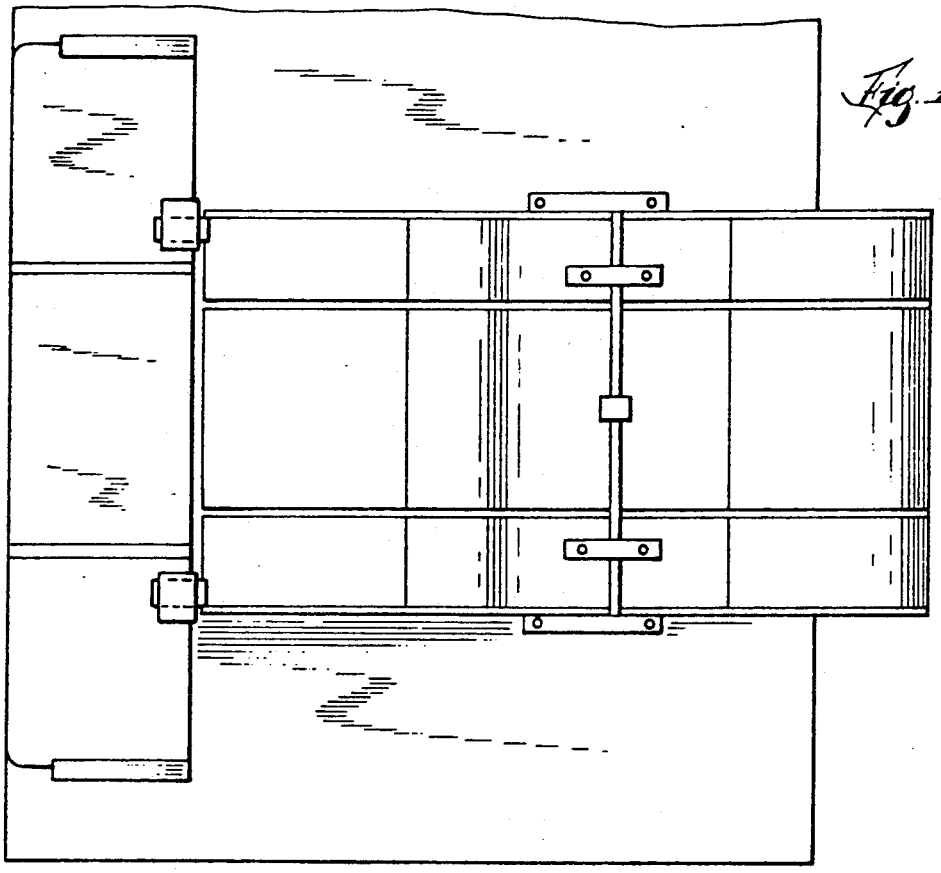
Figure 14B:
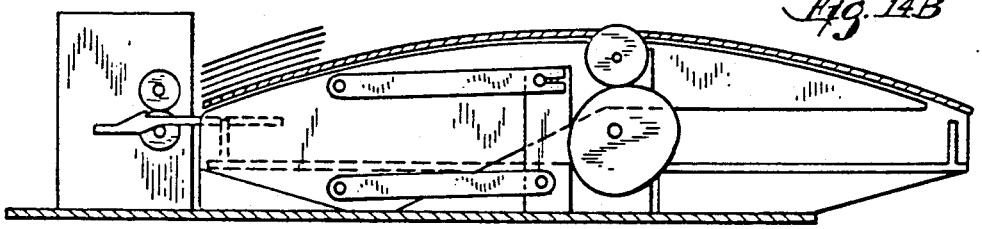
Figure 14A:
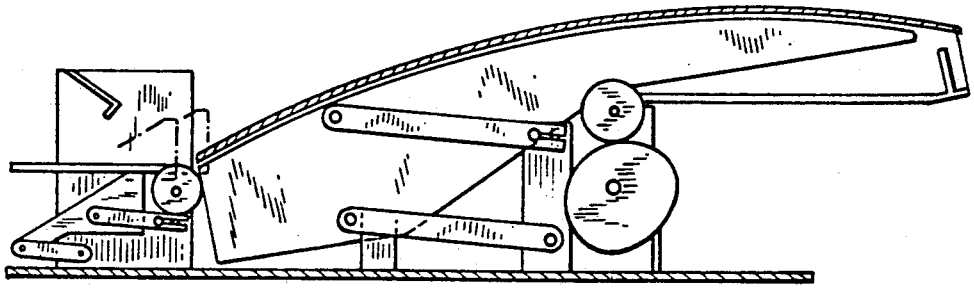

FIGS. 14*a*, *b*, *c*, and *d* illustrate several positions of the overall view of the bottom-fed receiving tray.

Figure 15:
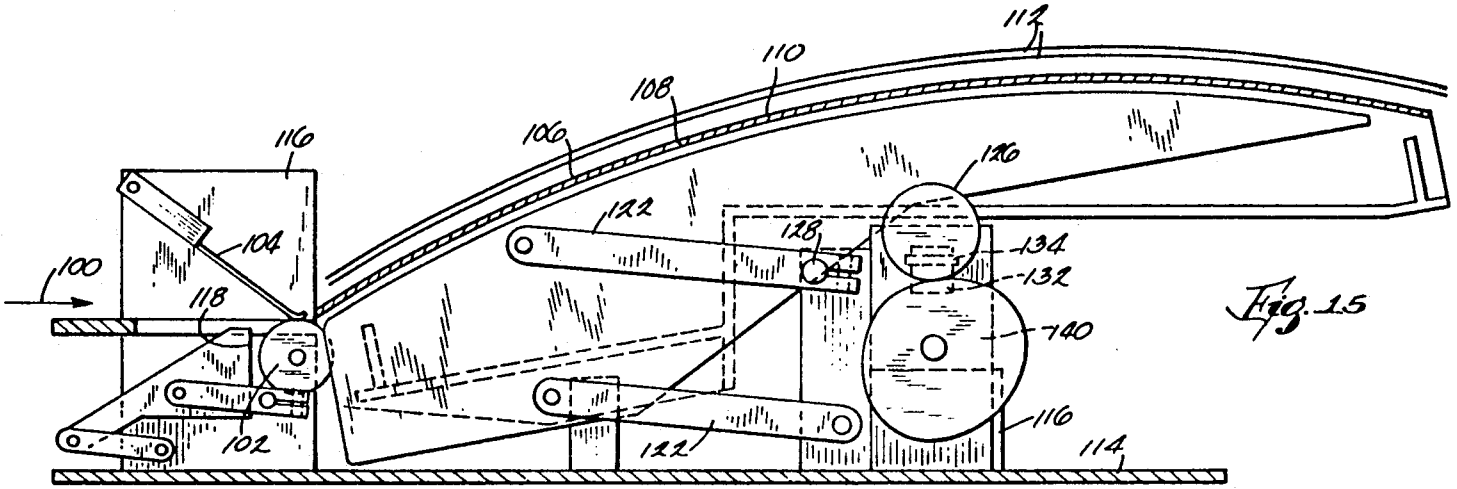

FIG. 15 is an enlarged view of FIG. 14*a*.

Figure 16:
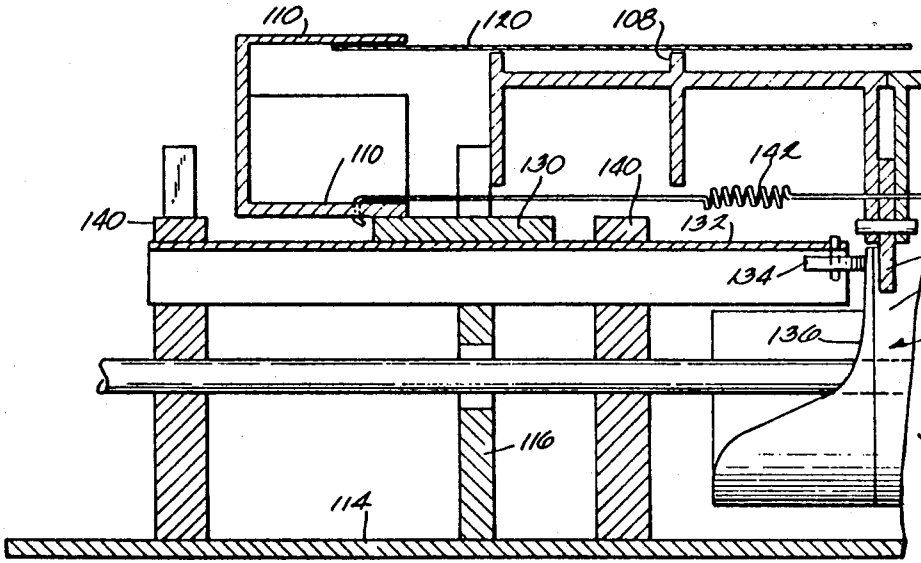

FIG. 16 is a vertical cross-sectional view of one-half of the plate model.

Figure 17:
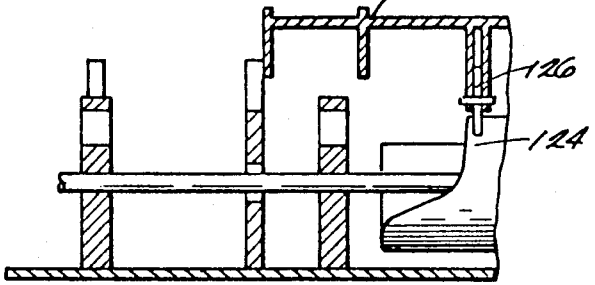

FIG. 17 is a vertical fragmentary cross-sectional view of the cam and shaft motion.

Figure 18:
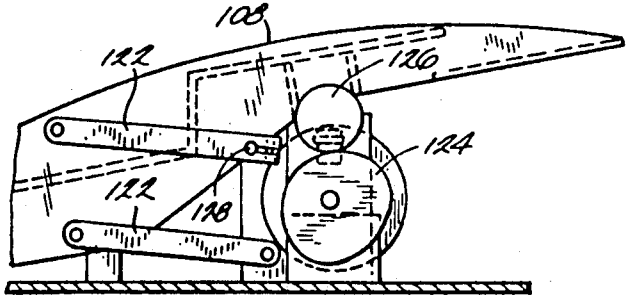
Figure 14D:
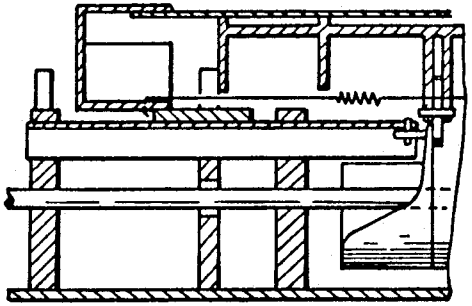

FIG. 18 is a view similar to FIG. 14*a* showing the shaft and cam motion.

Figure 19:
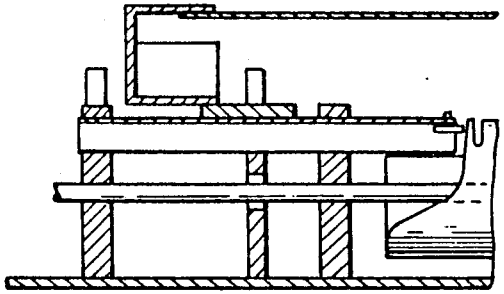
Figure 20:
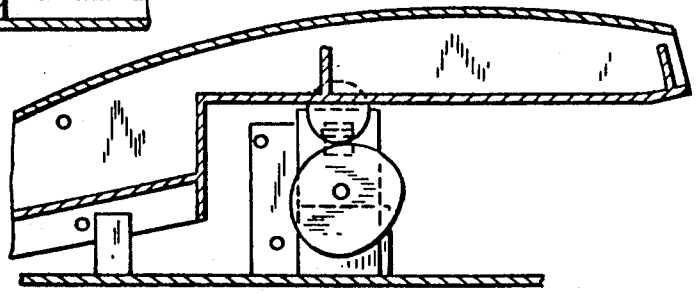

FIGS. 19 and 20 are similar to FIG. 17 and 18 showing with more clarity the edge supports.

Figure 21:
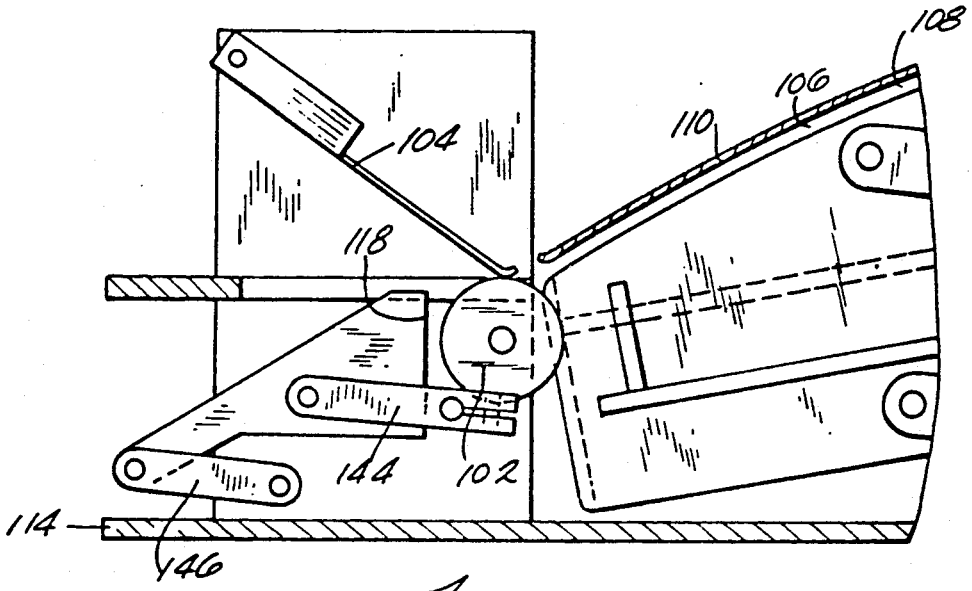

FIG. 21 is an enlarged view of the drive and entry mechanism.

Figure 22:
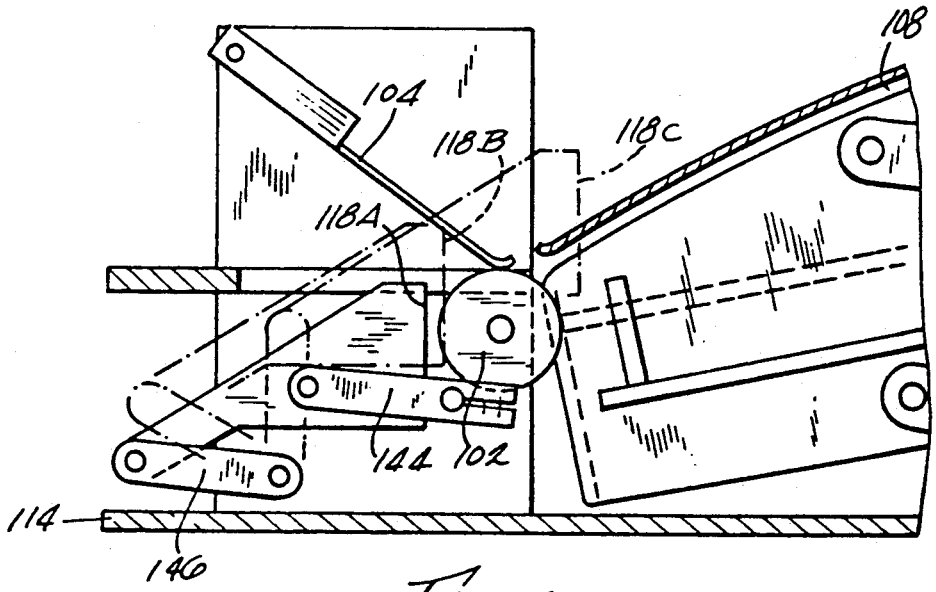

FIG. 22, similar to FIG. 21, illustrates the sheet pusher.

Figure 23C:
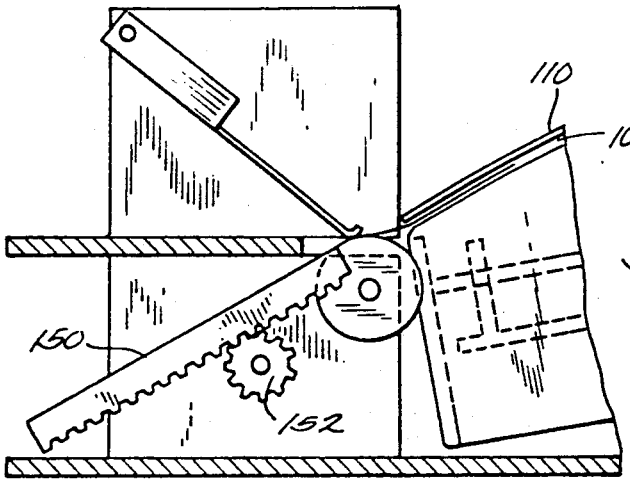
Figure 23B:
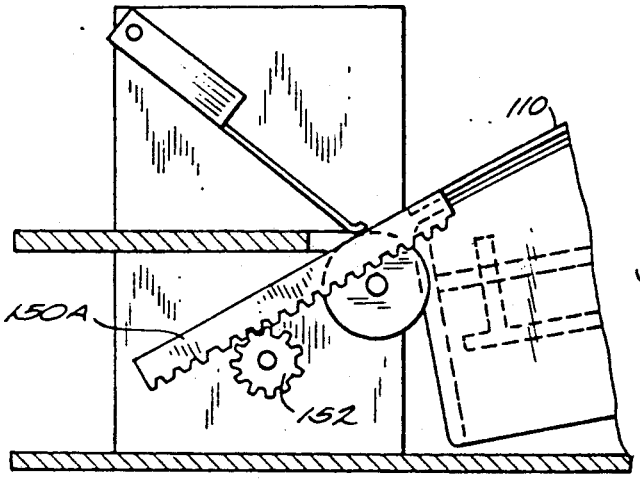
Figure 23A:
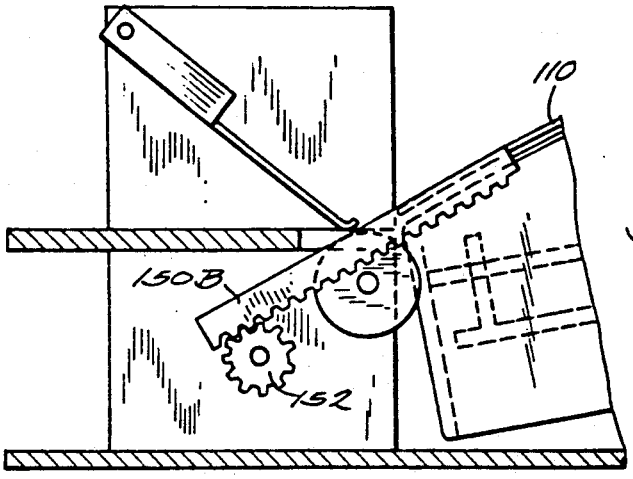
Figure 24A:
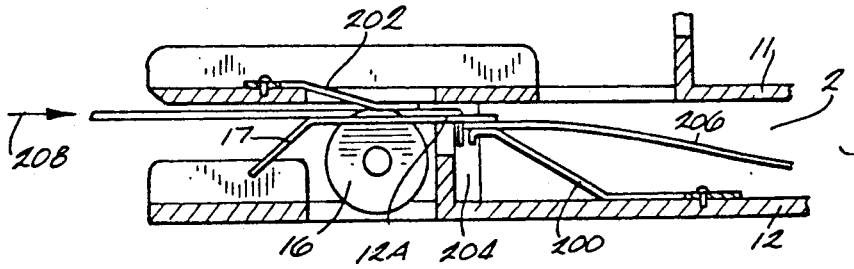
Figure 24B:
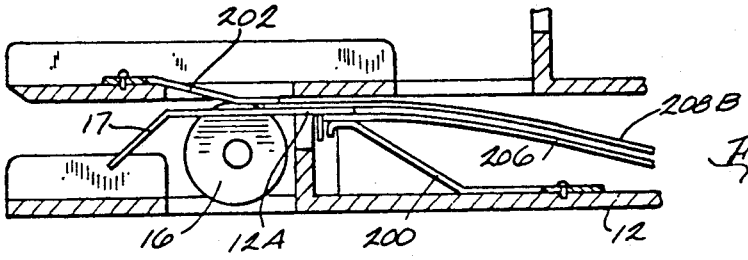
Figure 24C:
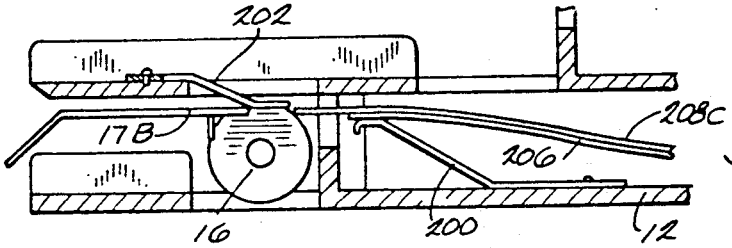
Figure 24D:
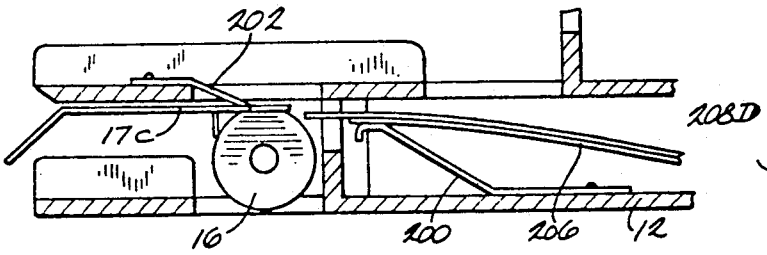
Figure 24E:
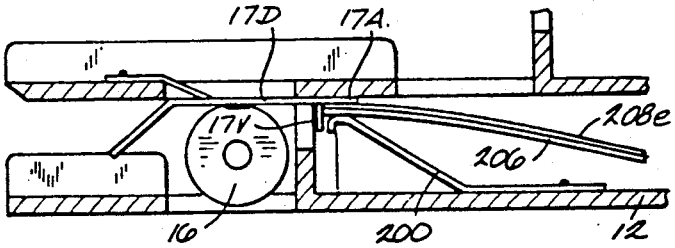
Figure 24F:
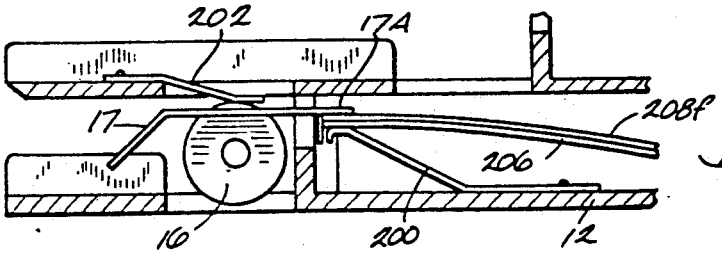

FIG. 23*a*, 23*b*, and 23*c* illustrate an alternate design of the sheet pusher.

FIGS. 24*a*, 24*b*, 24*c*, 24*d*, 24*e*, and 24*f* illustrate the sheet movement where a more positive paper control is required.

Referring now to the drawings, the following describe in more detail a specific construction and operation of the sorter and receiving tray of the present invention.

FIG. 1:

This is an overall view of most of the layers. The several positions of the fingers 17 and the moving frame 23 that holds them are not in this figure.

There are two stationary side frames 1 that support the shafts and fixed guides. The five sorting trays 3 have a tray area 2 for the sheets. These areas are staggered to make the removal of sheets from any tray easier.

The paper enters as shown by arrow 4 and is guided by the fixed, funnel-like guide 5.

FIG. 2:

This is a closer view of the working area.

The paper entering as shown 4 hits the top of the pivoting arm 6 which swings into the photoswitch 7 as the paper moves to the feed rollers 8. The switch 7 turns on a motor that drives the rollers 8 to drive the paper to the right. The paper guides 5 and the rollers 8 may be part of the printer.

The paper is guided by the pivoting paper guides, shown horizontal as 9, and in another position 10 to feed paper into tray 1. There are extra guides 9*a* to be sure that the paper is properly directed. The paper is directed by 9 into the stacking area defined by solid tray parts 12 and 11.

FIG. 3:

This is a plan view (from the bottom) of the side frame 1, the drive hubs 21, and the shafts 21*b*.

This drawing is repeated as FIG. 10.

FIG. 4:

This shows a simplified view to make the paper motion clear. This is the overall view.

FIG. 5:

The paper enters the area as shown 4, is driven by rollers 8 through the guides 9 as shown 13, toward the trays 4, and aided by drive tire 16, and spring 18 into the #3 tray area 2 as shown 15.

FIG. 6:

A larger view of FIG. 5. Some sheets 16 are shown in the tray area 2 They are shown with the left end curling up but restrained by the horizontal fingers 17*a* of part 17. There is a clear path paper 14*a* over fingers 17 and under spring 18 for the next sheet. The clear path is also shown as 14*b* and is now occupied by the tail of the paper sheet 16*a*. The passage 14*b* is under the spring 18 and over the left end of the tray 12*a*. Sheet 16*a* is shown. It has just entered the tray area and has been driven to the right as far as the drive tire 16, working with the spring 18, can drive it. This sheet 16*a* is not yet fully in the tray. If it were here when a new sheet entered, there would be a head-to-tail crash of the paper.

All of the trays have the details covered for tray area #3.

FIG. 7:

Several positions of the pivoting gate are shown. Position 19 is to feed paper to tray 1. Position 20 is to feed paper into tray 5.

FIG. 8*a*:

This is the "home" position.

Figure 6:
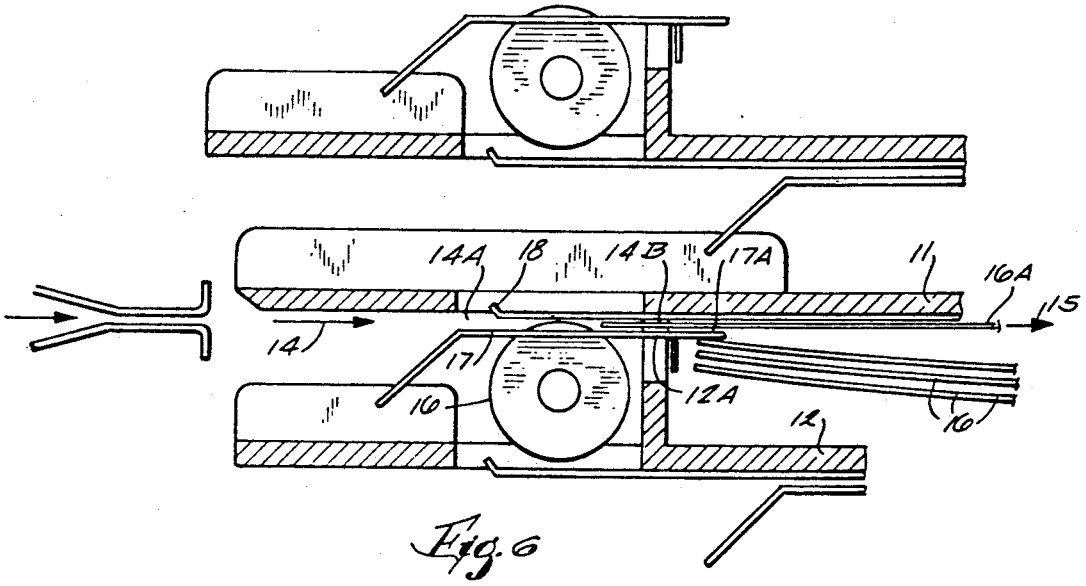
FIG. 6 is an enlarged view of the mechanism shown in FIG. 5.

The tray fingers 17 are shown in their "home" position, as also seen in previous figures. Refer to FIG. 6 for a larger view. FIG. 6 also shows the position of a sheet that is only partly in the tray.

FIG. 8*b*:

Here the fingers 17*b* have moved to the left so that the right end of the fingers is to the left of the sheet partly in the tray 16*a*.

FIG. 8*c*:

The fingers 17*c* have risen so that the horizontal tip at the right end is over the paper path 14*a* and 14*b*, but the vertical part of finger 17 is across the paper path.

There are many fingers across the sheet of paper and ribs of the tray between the fingers. Thus the fingers are free to move as shown. The tray 11 ribs keep the curled up end of a sheet from curling higher than the lower surface of the bottom of tray 11 so that the right tip of the fingers 17*a* are free to go to the left over all the sheets 16 and 16*a*.

FIG. 8*d*:

The fingers 17*d* have moved to the right and the vertical part of the fingers have pushed any paper 16*a* fully into the tray. The right tips 17*a* of the fingers are over the tail end of the new sheet 16*a*.

Figure 8A:
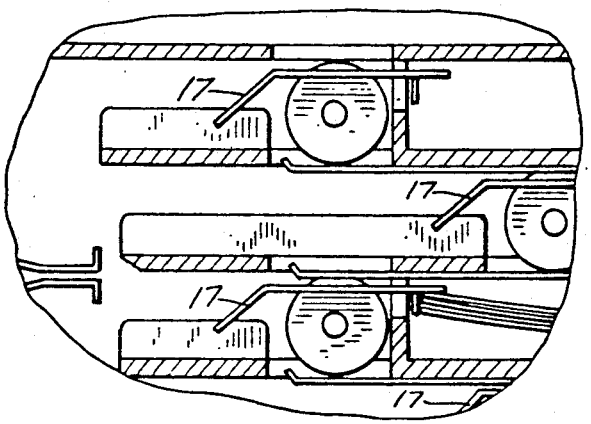
Figure 8B:
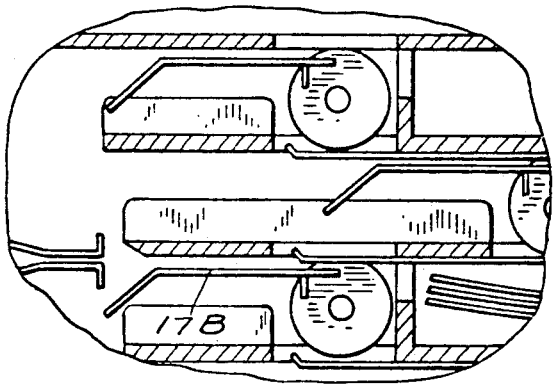
Figure 8C:
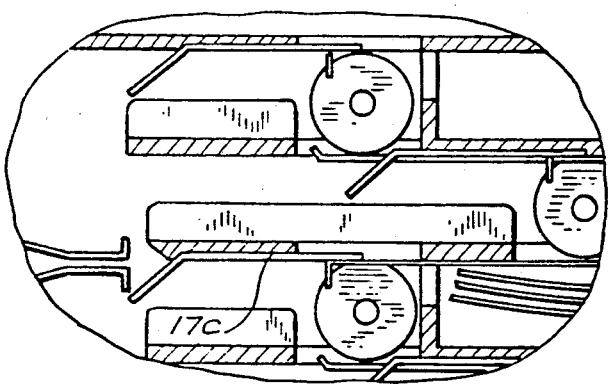
Figure 8D:
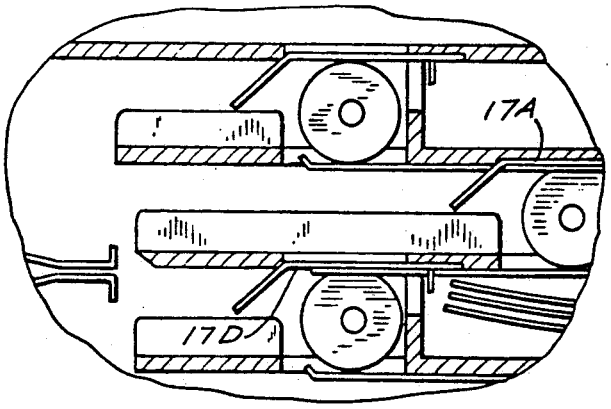

The fingers then move to their "home" position as shown in FIG. 8*a*.

FIG. 9:

The drive rollers 8 and the drive tires 16 are driven by the motor shaft MS and seven drive hubs 21 working with the plate 22. The drive hubs have a slot 21*a* between the shaft 21*b* and the drive pin 21*c* to provide some radial spring to compensate for dimensional errors of manufacture.

FIG. 10:

This is a plan view (from the bottom) of the side frame 1, the drive hubs 21, and the shafts 21*b*.

FIG. 11:

Here the drive hubs 21 have rotated 30 degrees and the plate 22 is in a new position.

As the motor shaft MS rotates its hub 21, it moves the plate 22. The plate moves the other hubs to drive the shafts of the sorter. At least three drive hubs are needed so that the position of the plate 22 is defined at all times.

FIG. 12*a:*

This is the "home" position.

The fingers 17 are mounted on a pair of plates 23 that are spring 32 loaded down and to the right. The left end of each plate is positioned but allowed to slide in a slot 1*a* in the frames 1. The right end of each plate is positioned by the circular cams 30 pushing of the ends of the plates 23 and against the spring force. It is also positioned by the arms 33 fixed to the frames 23 and resting on cams 31.

The end of finger 33 is on switch 34 and makes the switch in this position. If any of the trays are full, the fingers 17*a* on top of the sheets 16 in the tray will prevent the fingers and the moving frames 23 from going "home". As the frames 23 are not "home", the switch 34 is not made. This is the tray-full indication.

FIG. 12*b:*

The cams 30 and 31 are one piece, and another similar piece is on the other side. As they rotate as indicated in FIG. 12*a*, the plates and the fingers are driven to the left as shown in this figure.

FIG. 12*c:*

Further rotation of the cams 30 and 31 cause the arms and frames 33 and 23*c* to be lifted to the larger diameter 31*b*. This lifts the frames 32*c* and the fingers 17*c*.

FIG. 12*d:*

Further rotation of the cams 30 and 31 allow the spring 32 to pull the frames 23*d* to the right.

The next small rotation of the cams bring us to the "home" position.

FIG. 13:

This shows a switch in tray #3. The switch is apt to be added to all trays, but is shown only in tray #3 for clarity.

There is a wire 24 in a cavity of tray 11 but, in the "home" position, out of the way of an incoming sheet. The wire 24 goes through a hole in tray 11 and pivots in the hole. The other end of the wire is well behind the paper path and is bent down to connect with link 25 which is attached to the finger frame 23. As the finger frame 23 moves, the link 25 is pulled to the left and this rotates spring 24.

With no paper in the tray, the spring will rotate to position 24*c*. Here it will make contact with the wire 26 in the bottom tray. This electrical contact is recorded and indicates that the tray is empty of paper.

With paper in the tray 16, the spring 24*b* is prevented from making contact and no electrical contact is made as the moving finger frames 23 move through their cycle.

FIG. 14*a*, 14*b*, 14*c*, 14*d:*

These are overall views of all the layers and views of the drawings. The other figures are taken from it. The views are as marked. These figures allow one to identify the position, scale, and view of the other figures.

FIG. 15:

The sheet of paper, normally face up, enters as shown 100 and is driven by rollers 102, with spring fingers 104 providing the normal force needed. The paper goes into the space 106 which is over the center part 108 and under the edge supports 110. Any sheets that are already in the tray are on top of the edge supports, as shown 112.

The plate model has all the parts supported on plate 114. There are vertical members such as 116 and 140 that serve as bearings for the shafts and sliding members.

This model is not powered, but a production product would have motors with suitable speed reductions to provide the motions needed. A paper switch and suitable logic would also be needed. This logic would provide the product with the following operation:

Paper hits the paper switch before it gets to the roller 102. The switch turns on the roller drive.

The paper is driven until the sheet is in the space 106 and the tail leaves the switch. The drive continues for a short while until the paper is beyond the drive rollers 102, and the drive rollers stop.

A second motor is started from a defined home position and turns a cam 138 for one revolution and then it stops, again at the home position.

This drive may also move the end pusher 118 into the paper path to position 118*c* while pushing the new sheet 120 fully to the right.

As an alternate, the motion of the pusher can be to either of two positions (150*c* or 150*d*) so that sheets in the stacking area are offset in the right or left. The pusher in this case would be of a different shape as shown in FIG. 39 and effect only the sheet in the clear space 106.

Further turning of the cam 138 causes the side supports 110 to move out to drop the sheets already in the tray and above the supports 112 to be dropped to the new sheet 120 on the center support 108.

Then the center support rises taking all the sheets up with it.

Then the edge supports come back into their normal position and under the edges of the sheets.

And the center support is lowered to its normal position. All parts are now in their normal or "home" position. All the sheets are supported at two opposite edges by the curved edge supports, in the curved position of the sheets 112. The curve of the edge supports is necessary because, as a sheet of paper is curved and supported as shown, it cannot curve in another direction and fall between the edge supports.

FIG. 16:

This end view section shows one half of the plate model. The center support 108 and the edge supports 110 define a clear space filled by the new sheet 120 just put into the tray.

The center support 108 is guided by four arms 122 connected to the base 114 to insure that it does not rotate as it is lifted by the action of the cam surface 126 on the roller 124. Two of the arms 122 are clamped to shaft 128 so that they will move together.

The edge support 110 is connected via block 130 to the sliding part 132. There is a roller 134 mounted to the end of part 132. The sliding part is guided in fixed supports 140.

These parts are mirrored on the other side of the centerline, and spring 142 connects them to pull both sliding parts into contact with the face cam surfaces 136.

FIGS. 17 and 18:

The center support 108 is stabilized with arms 122 and shaft 128 and is gravity loaded through wheel 126 onto the radial cam surface 146 at the center of the cam 138.

FIGS. 19 and 20:

The two views of the edge supports are provided for clarity.

FIG. 21:

The enlarged view of the drive and entry show the parts more clearly. The end pusher 118 is stabilized with a pair of arms 144 which clamp on a common shaft and arms 146. This figure shows the home position.

FIG. 22:

The pusher is shown in as it rises and pushes a sheet into the stacking area. This motion is shown 118*a*, 18*b* and 118*c*.

FIGS. 23*a*, 23*b*, 23*c*:

An alternate design of the sheet pusher is shown in its home position 150 and in two final positions 150*a* and 150*b*. Note that the pushers affect only the sheet just fed into the clear area 106 and not sheets that are in the tray above the side supports 110. The pair of pushers 150 are guided to move only along their length and are driven by a pair gears 152.

Thus the several sheets of one document may be pushed to 150*a* and the pages of the next pushed to 150*b*, and the next set pushed to 150*a*, etc. The result is a stack of documents that are separated by a left or right position and can be more easily separated for distribution.

FIG. 24:

For more positive paper control, needed with higher speeds as an example, the spring 200 is added to the bottom tray 12 and spring 202 is added to the top tray 11 of the tray stacking area 2. The spring 200 pushes up but the upward motion is limited by the top of slot 204 of tray 12. When the fingers 17 are in their home position as shown here, any paper in the tray 206 is pinched between the top of spring 200 and the bottom of finger 17.

A new sheet 208 is shown entering as indicated by the arrow, and the lead edge of the paper sheet has pushed up spring 202. The spring 202 is split to be close on either side of the drive tire 16.

FIG. 24*b*:

The new sheet 208*b* is driven as far into the tray as the tire 16 can, and then comes to a stop with its tail end being pinched below spring 202 and the top of the tray end 12*a*.

FIG. 24*c*:

The finger 17*b* is moved to the left.

FIG. 24*d*:

Then finger 17*c* is moved up.

FIG. 24*e*:

The finger 17*d* is moved to the right with the right tips of the fingers 17*a* over the new sheet and with the vertical portion of the finger 17*v* pushing the new sheet 208*e* fully into the tray area.

FIG. 24*f*:

The finger 17 has gone down to its home position and now is gripping sheets 208*f* and 206. The sorter parts are now home and another sheet can enter as shown by the arrow.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desired to protect by Letters Patent are the following:

1. In a paper stacker with one or more trays, each tray having at least one drive shaft and at least one drive tire associated therewith to move a paper sheet to a stacking area and means to positively push the trailing edge of that sheet fully into the stacking area, the means to push the paper sheet comprising at least two fingers disposed perpendicular to the paper, into the paper path behind the trailing edge of the sheet when the sheet has been driven beyond the drive tire, the fingers then being moved in the direction of the paper motion to push the paper sheet fully into the stacking area, after which said fingers move out of the paper path.

2. In a paper stacker with one or more trays, each tray having at least one drive shaft and at least one drive tire associated therewith to move a paper sheet to a stacking area and means to positively push the trailing edge of that sheet fully into the stacking area, the means to push the paper sheet comprising at least two fingers disposed perpendicular to the paper, into the paper path behind the trailing edge of the sheet when the sheet has been driven beyond the drive tire, the fingers then being moved in the direction of the paper motion to push the paper sheet fully into the stacking area, after which said fingers move out of the paper path, and said fingers arranged to push the paper sheet to one of tow or more positions within the stacking area in order to have the paper sheets in the stack separated into sets which are offset in the direction of the paper motion.

3. In a paper stacker with one or more trays, each tray having at least one drive shaft and at least one drive tire associated therewith to move a paper sheet to a stacking area and means to positively push the trailing edge of that sheet fully into the stacking area, the means to positively push the paper sheet arranged to push the paper sheet to at least two differing positions in the stacking area.

4. In a paper stacker with one or more trays, each tray having at least one drive shaft and at least one drive tire associated therewith to move a paper sheet to a stacking area, and fingers to positively push the trailing edge of a sheet fully into the stacking area and hold the trailing edge of a sheet in the tray away from the path of another sheet entering the tray, some of the fingers having a portion parallel to the paper as well as perpendicular thereto and having motion such that the fingers come into the paper path behind the tail of another sheet with the parallel portions above the sheet, said fingers then arranged to move in the direction of the paper motion to push the sheet into the stacking area, then toward the sheets already in the tray thereby pushing the edges of the said another sheet toward the stack, said motion thus clearing a passage for the free entry of another sheet.

5. A paper stacker with one or more trays, each tray having at least one drive shaft and at least one drive tire associated therewith to move a paper sheet to a stacking area and means to positively push the trailing edge of that sheet fully into the stacking area, and to hold that sheet out of the paper path of another sheet, said positively pushing means being a set of fingers with a portion disposed to lie parallel to the another sheet and a portion disposed to lie perpendicular to the sheet, said fingers normally positioned to hold the sheets in the tray away from the path of another sheet entering the tray, and positioned to push another sheet into position and to capture the tail edge of the another sheet on the side of the parallel fingers away from the paper path of another sheet entering the tray.

6. A paper stacker with one or more trays, each tray having at least one drive shaft and at least one drive tire associated therewith to move a paper sheet to a stacking area and means to positively push the trailing edge of that sheet fully into the stacking area, and to hold that sheet out of the paper path of another sheet, said positively pushing means being a set of fingers with a portion disposed to lie parallel to the another sheet and a portion disposed to lie perpendicular to the sheet, said fingers normally positioned to hold the sheets in the tray away from the path of another sheet entering the tray, and positioned to push another sheet into position and to capture the tail edge of the another sheet on the side of the parallel fingers away from the paper path of another sheet entering the tray, said fingers arranged to move from their normal position on one side of another sheet entering the tray to a position behind the trailing edge of the another sheet that may have only partly entered the tray, and to move to the other side of the another sheet with the perpendicular portion behind the tail of the another sheet and the parallel portion above the another sheet, and then to move in a direction of the another sheet and push the another sheet fully int the tray with the tail edge of the sheet covered by the ends of the fingers, then move to the normal position, thereby capturing the another sheet and any sheets that may have been in the tray on the side of the fingers away from the next sheet to enter the tray.

7. The paper stacker of claim 6 wherein the motion of the fingers in a direction similar to, and opposite to, the motion of a sheet entering the tray being greater than the perpendicular motion.

8. A paper stacker with one or more trays, each tray having at least one drive shaft and at least one drive tire associated therewith to move a paper sheet to a stacking area, and means to positively push the trailing edge of that sheet fully into the stacking area and to hold that sheet out of the paper path of another sheet, said positively pushing means being a set of fingers with a portion disposed to lie parallel to the another sheet and a portion disposed to lie perpendicular to the sheet, said fingers normally positioned to hold the sheet in the tray away from the path of another sheet entering the tray, and positioned to push another sheet into position and to capture the tail edge of the another sheet on the side of the parallel fingers away from the paper path of another sheet entering the tray, and said fingers arranged to move after another sheet has been partly driven into the tray by the tire, said fingers arranged to move in a generally rectangular path, first in a direction opposite to the motion of the sheet entering the tray, then in a perpendicular direction, so that the parallel ends of the fingers reach to the side of the another sheet opposite to that of the rest of the sheets in the tray, then in a direction similar to the motion of an entering sheet, then to the initial position.

9. The paper stacker of claim 8 wherein the amount of motion of the fingers in a direction similar to, and opposite to, the motion of a sheet entering the tray is greater than the perpendicular motion.

10. A paper stacker with one or more trays, at least one drive shaft, and at least one drive tire to move a paper sheet to a stacking area, a printer, and means to positively push the trailing edge of a sheet fully into a stacking area and to hold that sheet out of the paper path of the next sheet, said trays being disposed essentially horizontal and arranged so that the paper sheet exits the printer and moves to the trays in one direction, the positively pushing means including a set of fingers below another incoming sheet to hold the trailing edge of the sheets already in the tray away from the path of the another sheet, a drive tire to move a sheet in said one direction from the printer to the tray, so that the paper sheet stops just after the sheet leaves the drive tire, the set of fingers arranged to move horizontally, after the sheet has been driven as far as possible by the drive tires and is mostly in the tray, in an opposite direction far enough that the ends of the fingers are disposed off-center of the drive tire, the set of fingers arranged to rise so that the horizontal tip of the fingers is above the top of the another sheet but the vertical tips of the fingers, somewhat to the left of the right ends of the fingers, still cross the defined paper path, the fingers arranged to move to the right to be over their home position, pushing the sheet to the right so that it is fully in the tray and with part of the fingers over the another sheet, the set of fingers arranged to move down to its normal position and thereby capture the trail edge of the another sheet both below the right ends of the fingers and to the right of the vertical portions of the fingers, thus holding the another sheet out of the path of yet another sheet that may enter the tray although the entire unit may be rotated to any angle, and where there are spaces between the fingers in the direction across the path of motion, and where there are matching spaces and fixed supports on the bottom left surface of the part defining the top of the tray space such that when the fingers rise to be over the new sheet the supports prevent the curled trailing edge of a sheet from rising and hitting the ends of the fingers as they move to the right of the spaces provided in the surface.

11. The paper stacker of claim 10 wherein there is more than one tray and there is a variable paper path between the printing unit and the trays so that the paper is directed into a specific tray.

12. The paper stacker of claim 11 wherein the variable paper path is one or more paper guides that swing about a pivot near the drive shaft.

13. The paper stacker of claim 12 wherein there is a guide part pivoted even nearer or concentric with the center of the drive shaft to guide the paper between the drive point on the drive tire and the paper guide surface.

14. A paper stacker with one or more trays, at least one drive shaft, and at least one drive tire to move a paper sheet to a stacking area, a printer, and means to positively push the trailing edge of a sheet fully into a stacking area and to hold that sheet out of the paper path of the another sheet, said trays being disposed essentially horizontal and arranged so that the paper sheet exits the printer and moves to the trays in one direction, the positively pushing means including a set of fingers below another incoming sheet to hold the trailing edge of the sheets already in the tray away from the path of the another sheet, a drive tire to move a sheet in said one direction from the printer to the tray, so that the paper sheet stops just after the sheet leaves the drive tire, the set of fingers arranged to move horizontally, after the sheet has been driven as far as possible by the drive tires and is mostly in the tray, in an opposite direction far enough that the ends of the fingers are disposed off-center of the drive tire, the set of fingers arranged to rise so that the horizontal tip of the fingers is above the top of the another sheet but the vertical tips of the fingers, somewhat to the left of the right ends of the fingers, still cross the defined paper path, the fingers arranged to move to the right to be over their home position, pushing the sheet to the right so that it is fully in the tray and with part of the fingers over the another sheet, the set of fingers arranged to move down to its normal position and thereby capture the trail edge of the another sheet both below the right ends of the fingers and to the right of the vertical portions of the fingers, thus holding the another sheet out of the path of yet another sheet that may enter the tray although the entire unit may be rotated to any angle, and where they are multiple gates and a sheet transport path for the incoming sheets, and where a gate is moved into the transport path to deflect the sheet into one tray.

15. A paper stacker with one or more trays, at least one drive shaft, and at least one drive tire to move a paper sheet to a stacking area, a printer, and means to positively push the trailing edge of a sheet fully into a stacking area and to hold that sheet out of the paper path of another sheet, said trays being disposed essentially horizontal and arranged so that the paper sheet exits the printer and moves to the trays in one direction, the positively pushing means including a set of fingers below another incoming sheet to hold the trailing edge of the sheets already in the tray away from the path of the another sheet, a drive tire to move a sheet in said one direction from the printer to the tray, so that the paper sheet stops just after the sheet leaves the drive tire, the set of fingers arranged to move horizontally after the sheet has been driven as far as possible by the drive tires and is mostly in the tray, in an opposite direction far enough that the ends of the fingers are disposed off-center of the drive tire, the set of fingers arranged to rise so that the horizontal tip of the fingers is above the top of the another sheet but the vertical tips of the fingers, somewhat to the left of the right ends of the fingers, still cross the defined paper path, the fingers arranged to move to the right to be over their home position, pushing the sheet to the right so that it is fully in the tray and with part of the fingers over the another sheet, the set of fingers arranged to move down to its normal position and thereby capture the trail edge of the another sheet both below the right ends of the fingers and to the right of the vertical portions of the fingers, thus holding the another sheet out of the path of yet another sheet that may enter the tray although the entire unit may be rotated to any angle, and where there is a cam surface to raise the fingers and gravity or a spring to pull the fingers down when the cam surface permits, and where a switch detects when the fingers are in the down position, and thus providing a signal that at least one tray is full preventing the fingers from going to their normal down position.

16. A paper stacker with one or more trays, at least one drive shaft, and at least one drive tire to move a paper sheet to a stacking area, a printer, and means to positively push the trailing edge of a sheet fully into a stacking area and to hold that sheet out of the paper path of another sheet, and said trays being disposed essentially horizontal and arranged so that the paper sheet exits the printer and moves to the trays in one direction, the positively pushing means including a set of fingers below another incoming sheet to hold the trailing edge of the sheets already in the tray away from the path of the another sheet, a drive tire to move a sheet in said one direction from the printer to the tray, so that the paper sheet stops just after the sheet leaves the drive tire, the set of fingers arranged to move horizontally after the sheet has been driven as far as possible by the drive tires and is mostly in the tray in an opposite direction far enough that the ends of the fingers are disposed off-center of the drive tire, the set of fingers arranged to rise so that the horizontal tip of the fingers is above the top of the another sheet but the vertical tips of the fingers, somewhat to the left of the right ends of the fingers, still cross the defined paper path, the fingers arranged to move to the right to be over their home position, pushing the sheet to the right so that it is fully in the gray and with part of the fingers over the another sheet, the set of fingers arranged to move down to its normal position and thereby capture the trail edge of the another sheet both below the right ends of the fingers and to the right of the vertical portions of the fingers, thus holding the another sheet out of the path of yet another sheet that may enter the tray although the entire unit may be rotated to any angle and where they are frames to hold the fingers that operate in each tray and provide the motion, and an electrically conductive conductor in the bottom surface of the tray area, a movable electrically conductive conductor in the top surface of the tray area, and the movable conductor is out of the paper path when a paper sheet is entering the tray, but, when paper is not entering, is moved through the tray area and contact the bottom conductor if there is no paper in the tray, the movable conductor being springy so that if there is one or more sheets in the tray , it is prevented from contacting the bottom conductor, and an electrical circuit and logic to record which trays had a closure of the circuit by touching of the wires and which did not.

17. The stacker of claim 16 where the motion or the movable electrically conductive wire or strip is provided by the motion of the frame supporting the fingers.

18. The stacker of claim 16 where the top conductor is fixed and the bottom conductor moves.

19. In a paper stacker with one or more trays, each tray having at least one drive shaft and at least one drive tire associated therewith to move a paper sheet to a stacking area and means to positively push the trailing edge of that sheet fully into the stacking area, and a spring disposed to grip the sheets already in a tray, the grip being provided by a spring having a fixed end and a moving finger, said sheets being kept away from the entry space of another sheet.

20. In a paper stacker with one or more trays, each tray having at least one drive shaft and at least one drive tire associated therewith to move a paper sheet to a stacking area and means to positively push the trailing edge of that sheet fully into the stacking area, and a spring disposed over the drive tire to push the sheet into the tray, said spring being on the side of the drive tire and positioned so that it grips the end of another sheet after it has been driven as far into the tray area as possible.

21. In a paper stacker with one or more trays, each tray having at least one drive shaft and at least one drive tire associated therewith to move a paper sheet to a stacking area and means to positively push the trailing edge of that sheet fully into the stacking area, and a spring disposed to grip the sheets already in a tray, the grip being provided by a spring having a fixed end and a moving finger, said sheets being kept away from the entry space of another sheet, a second spring disposed over the drive tire to push the sheet into the tray, said second spring being on the side of the drive tire and positioned so that it grips the end of another sheet after it has been driven as far into the tray area as possible.

* * * * *